US009216335B2

(12) United States Patent
Cheng

(10) Patent No.: US 9,216,335 B2
(45) Date of Patent: Dec. 22, 2015

(54) DETACHABLE GOLF BAG

(71) Applicant: Kai-Lun Cheng, Yuanli Township (TW)

(72) Inventor: Kai-Lun Cheng, Yuanli Township (TW)

( * ) Notice: Subject to any disclaimer, the term of this patent is extended or adjusted under 35 U.S.C. 154(b) by 168 days.

(21) Appl. No.: 14/017,416

(22) Filed: Sep. 4, 2013

(65) Prior Publication Data

US 2014/0367287 A1 Dec. 18, 2014

(30) Foreign Application Priority Data

Jun. 13, 2013 (TW) ..... 102211062 U

(51) Int. Cl.
*A63B 55/00* (2015.01)
*A63B 55/04* (2006.01)

(52) U.S. Cl.
CPC ..... *A63B 55/04* (2013.01); *A63B 55/045* (2013.01); *A63B 2210/50* (2013.01)

(58) Field of Classification Search
CPC ..... A63B 55/045; A63B 55/04; A63B 55/00; A63B 55/008
USPC ..... 206/315.1, 315.2, 315.3, 315.7; 280/47.18; 220/9.2, 6, 904
See application file for complete search history.

(56) References Cited

U.S. PATENT DOCUMENTS

| | | | | | |
|---|---|---|---|---|---|
| 2,435,479 | A * | 2/1948 | Thommen | 206/315.8 |
| 4,753,446 | A * | 6/1988 | Mills | 280/47.18 |
| 5,056,695 | A * | 10/1991 | Giblet | 224/484 |
| 5,156,366 | A * | 10/1992 | Anderson | 248/96 |
| 5,638,954 | A * | 6/1997 | Hsien | 206/315.8 |
| 5,941,383 | A * | 8/1999 | Cheng | 206/315.8 |
| 6,315,143 | B1 * | 11/2001 | Dotts | 220/9.2 |
| 2007/0138040 | A1 * | 6/2007 | Chan | 206/315.3 |
| 2011/0192689 | A1 * | 8/2011 | Wang | 190/124 |
| 2013/0241198 | A1 * | 9/2013 | Eaton et al. | 285/367 |

* cited by examiner

*Primary Examiner* — Fenn Mathew
*Assistant Examiner* — Cynthia Collado
(74) *Attorney, Agent, or Firm* — Jackson IPG PLLC; Demian K. Jackson

(57) ABSTRACT

The present invention provides a detachable golf bag, which is characterized by that: the support bars plugged between the upper frame and base of the golf bag comprise separately a first bar body, a second bar body and a coupling device; of which the coupling device can easily connect or disengage the first and second bar bodies to reduce the transportation space for the golf bag and also facilitate disassembly and assembly.

17 Claims, 7 Drawing Sheets

DETACHABLE GOLF BAG

BACKGROUND OF INVENTION

1. Field of the Invention

The present invention relates generally to a golf bag, and more particularly to an innovative one which can reduce the transport space and facilitate disassembly.

2. Description of Related Art

The conventional golf bags are usually assembled in the factory and then transported to the merchants or distributors for sale; however, the fixed volume will take much space for transportation and packaging, but also cause higher freight; moreover, common consumers can only select their preferred or appropriate bags according to individual demands, but cannot assemble by themselves, which is an important factor for higher golf bag cost and sales price.

For this reason, golf bags that can be assembled by merchants and distributors have been developed with smaller packing volume, more transportation capacity and less transportation cost (packaging and shipping by parts, not by finished products). Yet, the support bar connected between the upper frame and base of conventional self-assembly golf bag is designed into a long bar or plug-in type. The length of long bar type support bar is fixed but may also affect the reduction degree of packing volume, the plug-in type support bar can effectively reduce the packing volume, but it is likely to result in loosening and failure due to lack of strength. In fact, most of existing golf bag support bars are represented by above-mentioned two types, and recently, a screwed type is designed, but the screwed portion must be made of metals to ensure the robustness with higher fabrication cost.

SUMMARY OF THE INVENTION

The main purpose objective of the present invention is to provide a detachable golf bag, of which the support bars are incorporated into a multi-section structure via a coupling device, making it easy to disassemble and reduces the packing volume and transportation cost.

To this end, the present invention provides a detachable golf bag, which comprising: an upper frame, a base, several support bars and a rack; each support bar contains a first bar body, a second bar body and a coupling device; the coupling device contains a first coupling block, a second coupling block and an moveable sleeve; of which the first and second coupling blocks are separately set at one end of the first and second bar bodies, and the moveable sleeve is movably set on the outer side of the second bar body and the second coupling block; a first clamping part is set at one end of the first coupling block, and a second clamping part set at one end of the moveable sleeve.

BRIEF DESCRIPTION OF THE DRAWINGS

The present invention will be more readily understood with reference to the accompanying drawings.

DETAILED DESCRIPTION OF THE INVENTION

Figure 1:
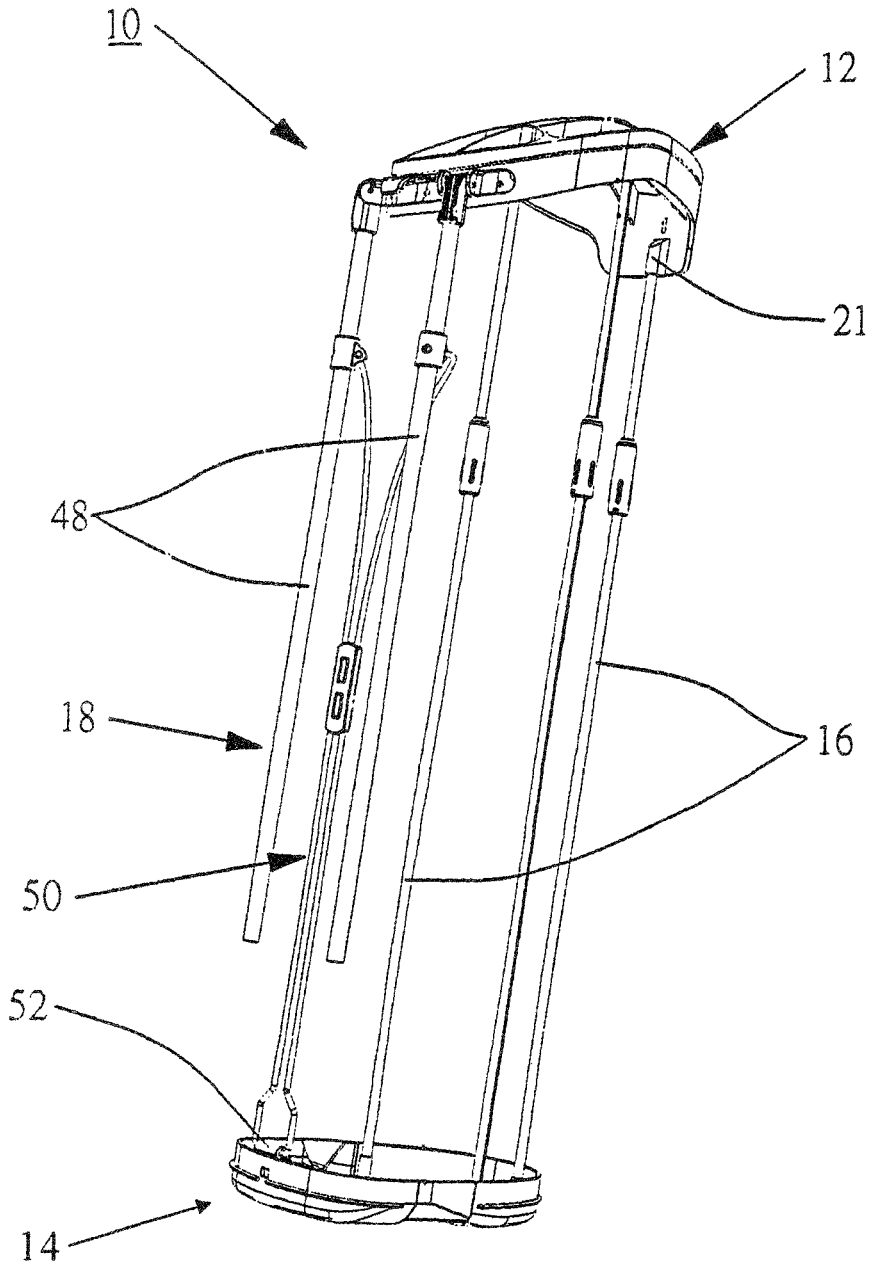
FIG. 1: a perspective assembly view of a preferred embodiment of the present invention.
Figure 2:
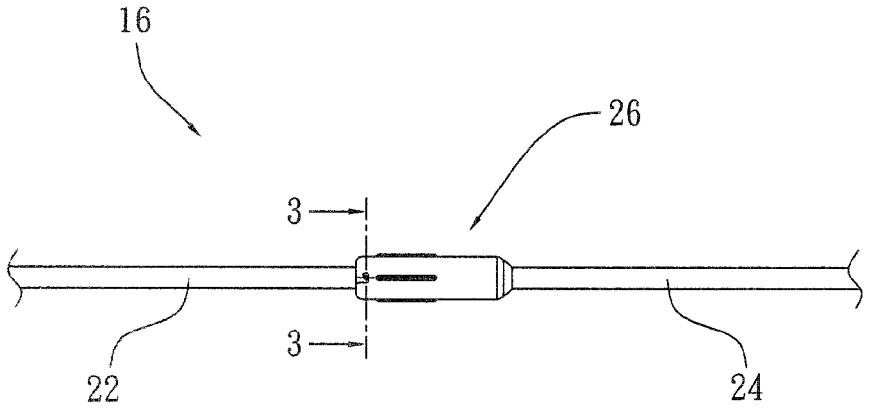
FIG. 2: an assembled view of the support bar in the preferred embodiment of the present invention.
Figure 3:
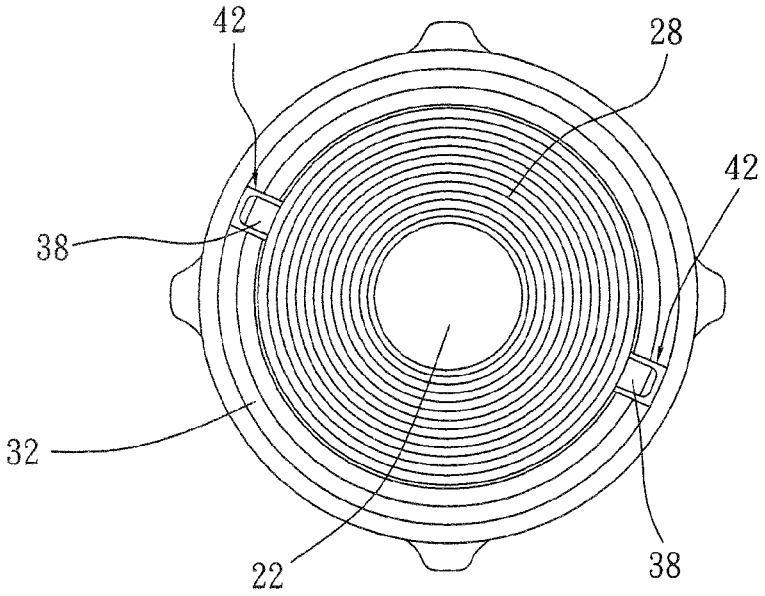
FIG. 3: a sectional view in 3-3 sectional direction of FIG. 2
Figure 4:
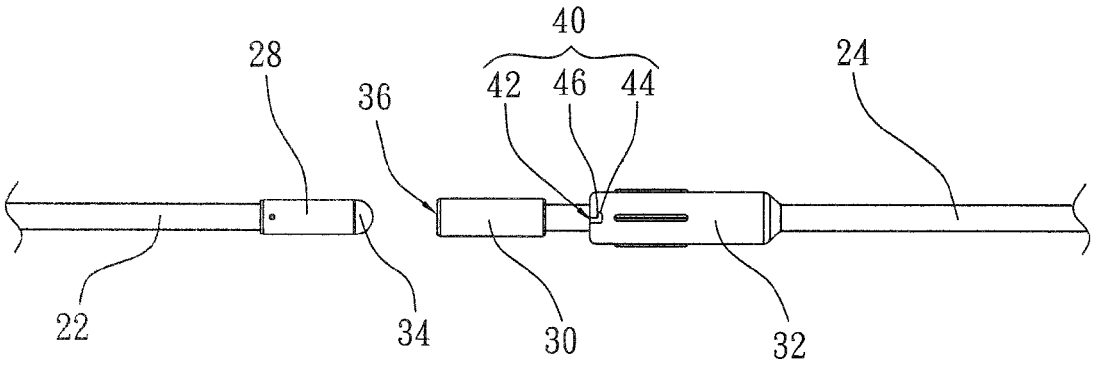
FIG. 4: an exploded view of the support bar in the preferred embodiment of the present invention.

Firstly, referring to FIGS. 1-5, the detachable golf bag 10 comprises: an upper frame 12, a base 14, three support bars 16 that can be detachably connected with the upper frame 12 and base 14, as well as a rack 18 that can be detachably connected with the upper frame 12 and base 14 to position the golf bag 10 vertically on the ground (e.g. bag body, strap); the above-mentioned upper frame 12, base 14, support bar 16 and rack 18 are assembled almost the same way as conventional golf bag. But, the golf bag 10 of the present invention is characterized by that:

The support bar 16, plugged detachably in the socket 21 between the upper frame 12 and base 14; it comprises of a first bar body 22, a second bar body 24 and a coupling device 26; the coupling device 26 contains a first coupling block 28, a second coupling block 30 and an moveable sleeve 32; the first and second coupling blocks 28, 30 are sleeve-shaped with one open end, and set securely at ends of the first and second bar bodies 22, 24; a first abutment portion 34 and a second abutment portion 36 are separately set at corresponding ends of the first and second coupling blocks 28, 30; the first abutment portion 34 is of a convex surface and the second abutment portion 36 is of a concave surface mated with the first abutment portion 34; convex first clamping parts 38 are separately set at two ends of the first coupling block 28 correspondingly to the first bar body 22; the moveable sleeve 32 is of a tubular shape with two open ends, and movably set on the outer side of the second bar body 24 and the second coupling block 30; and second clamping parts 40 are separately set at two ends correspondingly to the second coupling block 30; the second clamping part contains a guide slot 42, a caulking groove 44 and a clamping block 46; the guide slot 42 is set into the inner wall at one end of the moveable sleeve 32 and extended to the other end; the caulking groove 44 is set through the moveable sleeve 32 to the guide slot 42, and the clamping block 46 is set convexly at one side of the inner wall of the caulking groove 44.

Moreover, the rack 18 comprises of two support rods 48 pivoted to the upper frame 12, an elastic frame 50 connected with two metal wires, and one end is movably connected with two support rods 48, a plug-in unit 52, set at the other end of the elastic frame 50 and detachably set in a slot 54 set at one side of the base 14.

With this design, the golf bag 10 of the present invention is used in the same way as the conventional one; and its features and efficacy are as follow:

Based on the detachable structure of support bars 16, rack 18, upper frame 12 and base 14, the golf bag 10 has efficacy of reducing the packing volume and the transport cost (not assembled into finished products).

Figure 6:
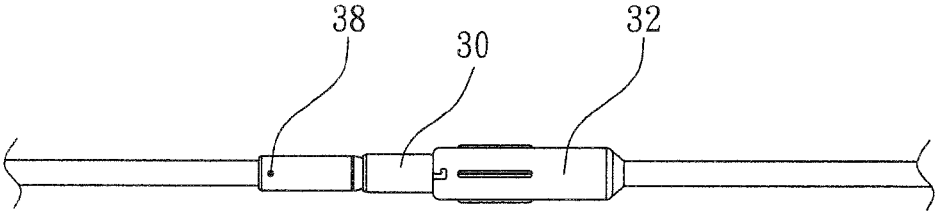
FIG. 6: a mating view of the first and second coupling blocks in the preferred embodiment of the present invention.
Figure 5:
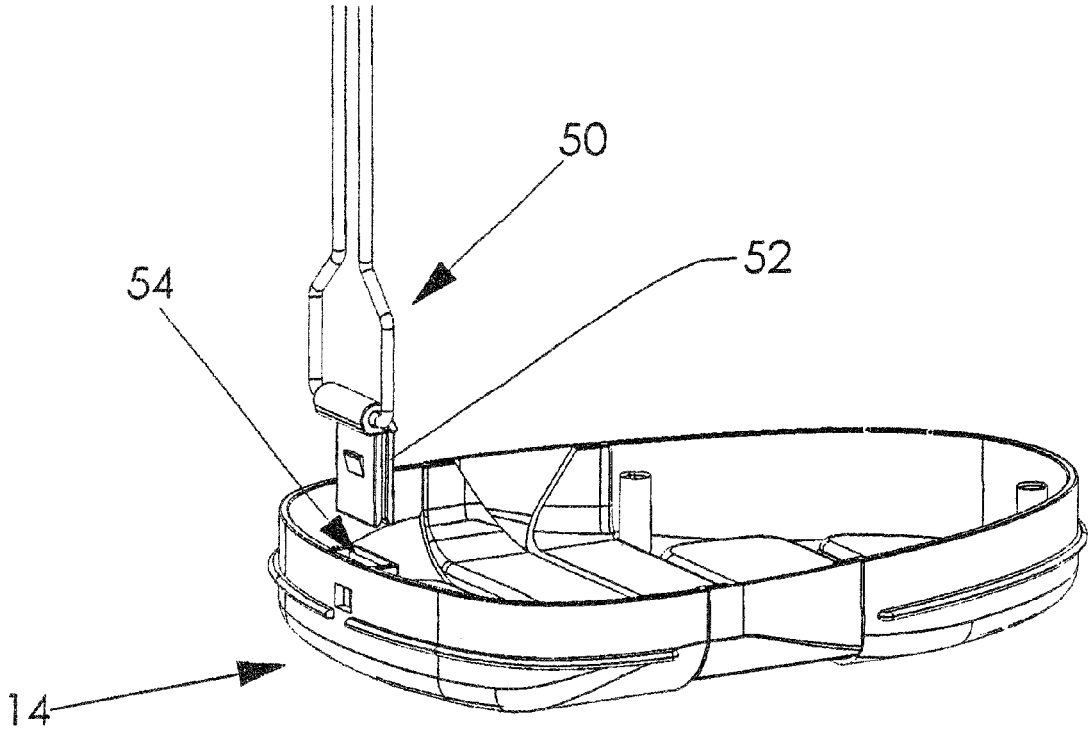
FIG. 5: an exploded view of the base and plug-in unit in the preferred embodiment of the present invention.
Figure 7:
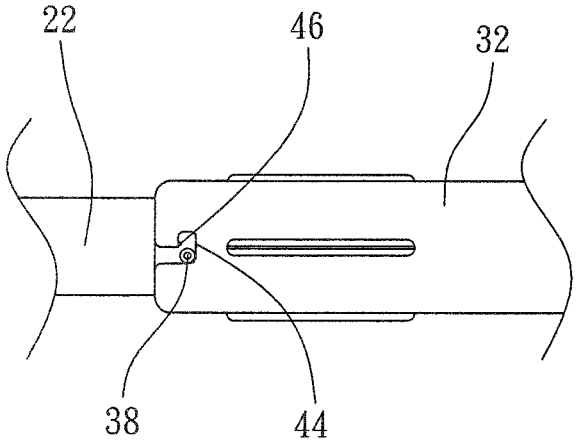
FIG. 7 and FIG. 8: assembly view of coupling device in the preferred embodiment of the present invention.
Figure 8:
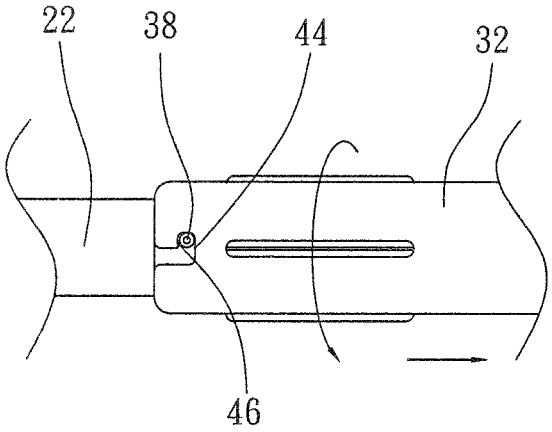

Particularly when it is intended for assembly of the support bars 16, the first and second bar bodies 22, 24 are separately inserted into the socket 12 between the upper frame 12 and base 14, then the first and second abutment portions 34, 36 of the first and second coupling blocks 28, 30 are abutted as shown in FIG. 6. Next, the moveable sleeve 32 is moved to cover the first and second coupling blocks 28, 30, such that the first clamping parts 38 could slide into the guide slot 42 to enter into one end of the caulking groove 44, as shown in FIGS.7 and 8. Thus, the moveable sleeve 32 is rotated such that the first clamping part 38 is abutted to the other end of the caulking groove 44; moreover, the moveable sleeve 32 is pulled backwards a little, so the first clamping part 38 is abutted to the clamping block 46 to prevent the first clamping part 38 disengaging from the caulking groove 44; this could complete the assembly of support bars 16 more easily and quickly. Certainly, the support bars 16 could be disassembled in reverse steps.

The support bars of the golf bag of the present invention are incorporated into a multi-section structure via a coupling device, so it has efficacy of reducing the packing volume and transport cost of the golf bag, but also enables easy and quick assembly; besides, the abutting of the first and second coupling blocks can be fixed by the moveable sleeve with robust state; therefore, there is need to use metal material for the first and second coupling blocks and the moveable sleeve. Compared to the conventional multi-section or screwed support bars, the present invention has obvious efficacy.

Figure 9:
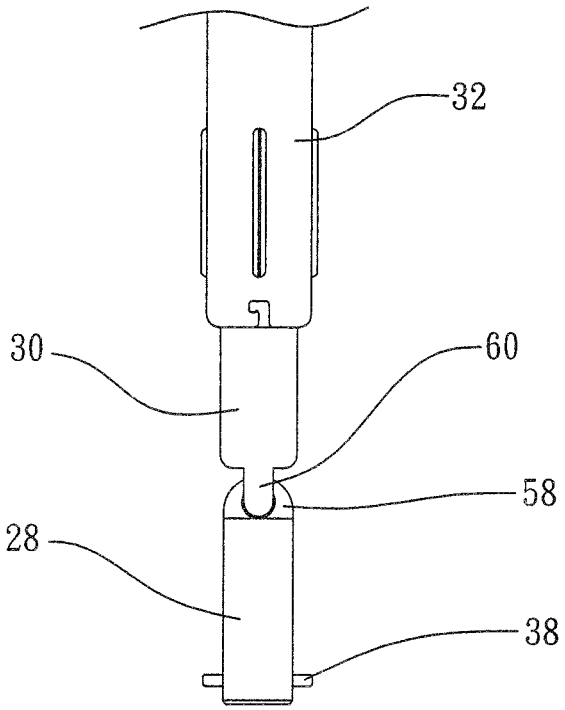
FIG. 9: an exploded view of the support bar of another preferred embodiment of the present invention.

Referring to FIG. 9, the first and second coupling blocks 28, 30 of the support bars 16 in the present invention can also be designed to be pivotally connected by a pivot seat 58 and a pivot lug 60. Based on this, the first and second bar bodies of the support bars 16 are connected for quicker assembly.

Figure 10:
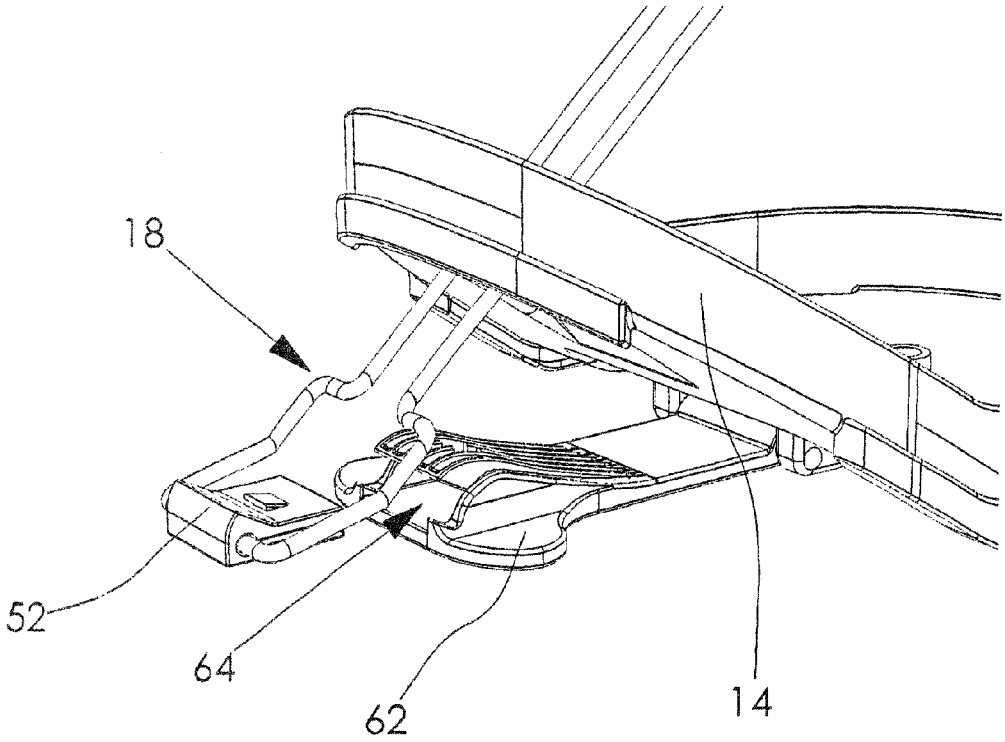
FIG. 10: an exploded view of the base and plug-in unit of another preferred embodiment of the present invention.

Referring also to FIG. 10, the plug-in unit 52 of the rack 18 can also be detachably inserted into a slot 64 of a drive plate 62 on the base 14.

What is claimed is:

1. A detachable golf bag, which comprising:

an upper frame, a base, support bars connected between the upper frame and the base, and a rack connected with the upper frame and base to position the golf bag vertically on a ground; it is characterized by that: each support bar contains a first bar body, a second bar body and a coupling device; the coupling device contains a first coupling block, a second coupling block and an moveable sleeve; of which the first and second coupling blocks are separately set at one end of the first and second bar bodies; at least a first clamping part is set at one end of the first coupling block; the moveable sleeve is of a tubular shape with two open ends, so that it can be movably set on an outer side of the second bar body and the second coupling block; and at least a second clamping part is set at its one end for clamping with the first clamping part; thus the support bars allow the moveable sleeve to cover an outer side of the first and second coupling blocks, and lock the first and second clamping part for assembly, wherein the corresponding ends of the first and second coupling blocks are pivotally connected.

2. The structure defined in claim 1, wherein a first and a second abutment portion are separately set at corresponding ends of the first and second coupling blocks for mating with each other.

3. The structure defined in claim 2, wherein the first abutment portion is of a convex surface and the second abutment portion of a concave surface.

4. The structure defined in claim 2, wherein the first clamping parts are set at one end of the first coupling block correspondingly to the first bar body; and the second clamping parts are set at one end of the moveable sleeve correspondingly to second coupling block.

5. The structure defined in claim 4, wherein the first clamping part is designed into a convex column, and the second clamping part contains a guide slot, a caulking groove and a clamping block; the guide slot is concavely set into the inner wall at one end of the moveable sleeve and extend towards the other end; the caulking groove is set through the moveable sleeve to the guide slot; the clamping block is convexly set at one side of the caulking groove's inner wall to prevent the first clamping part disengaging from the caulking groove when the first clamping part is stretched into the caulking groove for abutment.

6. The structure defined in claim 2, wherein the first and second coupling blocks are sleeve-shaped with one open end, and sleeved securely on the end of the first and second bar bodies.

7. The structure defined in claim 2, wherein the rack consists of two support bars correspondingly pivoted with the upper frame, a flexible frame body with one end movably connected with two support bars, a plug-in unit and a slot detachably set on the other end of the flexible frame body correspondingly to the base.

8. The structure defined in claim 2, wherein the rack comprises of two support bars correspondingly pivoted with the upper frame, a flexible frame body with one end movably connected with two support bars, a plug-in unit and a slot detachably set on the other end of the flexible frame body, a drive plate pivotally connected to one end of the base; and the plug-in unit is detachably inserted into a slot set on the drive plate.

9. The structure defined in claim 1, wherein a pivot seat and a pivot lug pivotally connected are set separately at the corresponding ends of the first and second coupling blocks.

10. The structure defined in claim 1, wherein the rack consists of two support bars correspondingly pivoted with the upper frame, a flexible frame body with one end movably connected with two support bars, a plug-in unit and a slot detachably set on the other end of the flexible frame body correspondingly to the base.

11. The structure defined in claim 1, wherein the rack comprises of two support bars correspondingly pivoted with the upper frame, a flexible frame body with one end movably connected with two support bars, a plug-in unit and a slot detachably set on the other end of the flexible frame body, a drive plate pivotally connected to one end of the base; and the plug-in unit is detachably inserted into a slot set on the drive plate.

12. The structure defined in claim 1, wherein the first clamping parts are set at one end of the first coupling block correspondingly to the first bar body; and the second clamping parts are set at one end of the moveable sleeve correspondingly to second coupling block.

13. The structure defined in claim 1, wherein the first and second coupling blocks are sleeve-shaped with one open end, and sleeved securely on the end of the first and second bar bodies.

14. The structure defined in claim 1, wherein the rack consists of two support bars correspondingly pivoted with the upper frame, a flexible frame body with one end movably connected with two support bars, a plug-in unit and a slot detachably set on the other end of the flexible frame body correspondingly to the base.

15. The structure defined in claim 1, wherein the rack comprises of two support bars correspondingly pivoted with the upper frame, a flexible frame body with one end movably connected with two support bars, a plug-in unit and a slot detachably set on the other end of the flexible frame body, a drive plate pivotally connected to one end of the base; and the plug-in unit is detachably inserted into a slot set on the drive plate.

16. A detachable golf bag, which comprising:

an upper frame, a base, support bars connected between the upper frame and the base, and a rack connected with the upper frame and base to position the golf bag vertically on the ground; it is characterized by that: each support bar contains a first bar body, a second bar body and a coupling device; the coupling device contains a first coupling block, a second coupling block and an moveable sleeve; of which the first and second coupling blocks are separately set at one end of the first and second bar bodies; at least a first clamping part is set at one end of the first coupling block; the moveable sleeve is of a tubular shape with two open ends, so that it can be movably set on the outer side of the second bar body and the second coupling block; and at least a second clamping part is set at its one end for clamping with the first clamping part; thus the support bars allow the moveable sleeve to cover the outer side of the first and second coupling blocks, and lock the first and second clamping part for assembly, wherein a first and a second abutment portion are separately set at corresponding ends of the first and second coupling blocks for mating with each other, wherein the first clamping parts are set at one end of the first coupling block correspondingly to the first bar body; and the second clamping parts are set at one end of the moveable sleeve correspondingly to second coupling block, wherein the first clamping part is designed into a convex column, and the second clamping part contains a guide slot, a caulking groove and a clamping block; the guide slot is concavely set into the inner wall at one end of the moveable sleeve and extend towards the other end; the caulking groove is set through the moveable sleeve to the guide slot; the clamping block is convexly set at one side of the caulking groove's inner wall to prevent the first clamping part disengaging from the caulking groove when the first clamping part is stretched into the caulking groove for abutment.

17. A detachable golf bag, which comprising:

an upper frame, a base, support bars connected between the upper frame and the base, and a rack connected with the upper frame and base to position the golf bag vertically on the ground; it is characterized by that: each support bar contains a first bar body, a second bar body and a coupling device; the coupling device contains a first coupling block, a second coupling block and an moveable sleeve; of which the first and second coupling blocks are separately set at one end of the first and second bar bodies; at least a first clamping part is set at one end of the first coupling block; the moveable sleeve is of a tubular shape with two open ends, so that it can be movably set on the outer side of the second bar body and the second coupling block; and at least a second clamping part is set at its one end for clamping with the first clamping part; thus the support bars allow the moveable sleeve to cover the outer side of the first and second coupling blocks, and lock the first and second clamping part for assembly, wherein the corresponding ends of the first and second coupling blocks are pivotally connected, wherein the first clamping parts are set at one end of the first coupling block correspondingly to the first bar body; and the second clamping parts are set at one end of the moveable sleeve correspondingly to second coupling block.

* * * * *